US012084801B2

(12) United States Patent
Lee et al.

(10) Patent No.: US 12,084,801 B2
(45) Date of Patent: Sep. 10, 2024

(54) WASHING MACHINE

(71) Applicant: Samsung Electronics Co., Ltd., Suwon-si (KR)

(72) Inventors: Sung-mo Lee, Gunpo-si (KR); Sang-ho Park, Suwon-si (KR); Kyung-up Lim, Seoul (KR); Seon-woo Lee, Incheon (KR); So-dam Han, Suwon-si (KR); In-hwan Kil, Yongin-si (KR); Jun-hyun Park, Osan-si (KR); Do-yeon Kim, Yongin-si (KR); Hoon Wee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 18/485,949

(22) Filed: Oct. 12, 2023

(65) Prior Publication Data

US 2024/0035221 A1 Feb. 1, 2024

Related U.S. Application Data

(63) Continuation of application No. 17/662,514, filed on May 9, 2022, now Pat. No. 11,814,773, which is a (Continued)

(30) Foreign Application Priority Data

Jun. 30, 2015 (KR) ..... 10-2015-0093124

(51) Int. Cl.
*D06F 33/48* (2020.01)
*D06F 37/02* (2006.01)
(Continued)

(52) U.S. Cl.
CPC ..... *D06F 37/14* (2013.01); *D06F 37/02* (2013.01); *D06F 37/12* (2013.01); *D06F 37/145* (2013.01);
(Continued)

(58) Field of Classification Search
None
See application file for complete search history.

(56) References Cited

U.S. PATENT DOCUMENTS 8,950,831 B2 2/2015 Kim et al.
9,200,401 B2 12/2015 Chung et al.
(Continued)

FOREIGN PATENT DOCUMENTS

EP 2597187 A1 5/2013
JP 2006-110065 A 4/2006
(Continued)

OTHER PUBLICATIONS

Notice of Preliminary Rejection dated Aug. 18, 2021, in connection with Korean Application No. 10-2015-0093124, 11 pages.
(Continued)

*Primary Examiner* — Levon J Shahinian

(57) ABSTRACT

A washing machine is provided. The washing machine includes a water tub configured to be disposed in a cabinet and to store wash water, a rotating tub configured to be rotatably installed in the water tub and to include an opening formed in an upper end portion thereof, and a driver configured to be connected to the rotating tub and to rotate the rotating tub, wherein a deviation preventer configured to prevent wash water in the rotating tub from being deviated to one side during rotation of the rotating tub is formed at an upper end portion of the rotating tub.

18 Claims, 10 Drawing Sheets

Related U.S. Application Data continuation of application No. 16/696,869, filed on Nov. 26, 2019, now Pat. No. 11,326,296, which is a continuation of application No. 15/143,334, filed on Apr. 29, 2016, now Pat. No. 10,494,750.

(51) Int. Cl.

| | |
|---|---|
| ***D06F 37/12*** | (2006.01) |
| ***D06F 37/14*** | (2006.01) |
| ***D06F 37/20*** | (2006.01) |
| ***D06F 37/24*** | (2006.01) |
| ***D06F 37/42*** | (2006.01) |

(52) U.S. Cl.

CPC ..... *D06F 37/20* (2013.01); *D06F 37/245* (2013.01); *D06F 37/42* (2013.01); *D06F 33/48* (2020.02)

(56) References Cited

U.S. PATENT DOCUMENTS

| | | | |
|---|---|---|---|
| 2013/0042656 | A1 | 2/2013 | Ekbundit et al. |
| 2013/0167596 | A1 | 7/2013 | Kang et al. |

FOREIGN PATENT DOCUMENTS

| | | | |
|---|---|---|---|
| JP | 2012-170686 | A | 9/2012 |
| JP | 2013-192862 | A | 9/2013 |
| JP | 2014-131592 | A | 7/2014 |
| KR | 10-1995-0011729 | A | 5/1995 |
| KR | 20-1998-0049713 | A | 10/1998 |
| KR | 10-1999-0054037 | A | 7/1999 |
| KR | 10-1999-0066654 | A | 8/1999 |
| KR | 10-2000-0056255 | A | 9/2000 |
| KR | 10-2004-0091265 | A | 10/2004 |
| KR | 10-2013-0080222 | A | 7/2013 |
| KR | 10-2014-0043543 | A | 4/2014 |

OTHER PUBLICATIONS

Office Action dated Nov. 25, 2020 in connection with United States U.S. Appl. No. 17/025,562, 9 pages.

Korean Intellectual Property Office, "Notice of Decision of Rejection" issued Feb. 24, 2022, in connection with Korean Patent Application No. 10-2015-0093124, 6 pages.

Request for the Submission of an Opinion dated Dec. 18, 2022 in connection with Korean Patent Application No. 10-2022-0038430, 9 pages.

Korean Intellectual Property Office, "Notice of Preliminary Rejection," issued Jun. 11, 2022, in connection with Korean Patent Application No. 10-2022-0038430, 7 pages.

Rejection Decision dated Jun. 27, 2023, in connection with Korean Patent Application No. 10-2022-0038430, 6 pages.

WASHING MACHINE

CROSS-REFERENCE TO RELATED APPLICATIONS

This application is a continuation of application Ser. No. 17/662,514 filed May 9, 2022, which is a continuation of application Ser. No. 16/696,869 filed Nov. 26, 2019, now U.S. Pat. No. 11,326,296, which is a continuation of application Ser. No. 15/143,334, filed Apr. 29, 2016, now U.S. Pat. No. 10,494,750, which claims priority to Korean Patent Application No. 10-2015-0093124, filed Jun. 30, 2015, the disclosures of which are incorporated herein by reference in their entireties.

BACKGROUND

1. Field

Apparatuses and methods consistent with the present disclosure relate to a washing machine, and more particularly, to a washing machine that prevents vibration of a rotating tub, which is caused when water is not drained during spin-dry of a laundry.

2. Description of Related Art

A washing machine is a machine used to wash laundry using power and in general, includes a water tub for storing wash water, a rotating tub rotatably installed in the water tub, a pulsator rotatably installed on a bottom of the rotating tub; and a motor and a clutch for rotatably driving the rotating tub and the pulsator.

When the rotating tub and the pulsator are rotated while laundry and detergent water are put in the rotating tub, the pulsator stirs the laundry put in the rotating tub together with the laundry so as to remove dirt stained on the laundry.

Conventionally, when laundry formed of a waterproof material is washed using the washing machine, wash water in the rotating tub is not drained from the rotating tub due to the laundry formed of a waterproof material during spin-dry of the laundry. The wash water that is not drained from the rotating tub is frequently deviated to one side in the rotating tub during high-speed spin dry, and in this case, the rotating tub abnormally vibrates due to the wash water that is deviated to one side. The abnormal vibration causes collision between the rotating tub and the water tub and thus, the washing machine is damaged.

Recently, as washing machines have become large-sized, a number of times of washing of large laundries such as blankets, curtains, and bed sheets have been increased, but when these large laundries are washed, some laundries may be separated from a rotating tub. In this case, some of the separated laundries are rotated together with the rotating tub but a water tub is stopped, and thus when some of the separated laundries come in contact with the water tub, the laundry is scraped on a contact surface of the water tub and is damaged. That is, both the laundry and the water tub are damaged due to friction between some of the separated laundries and the contact surface of the water tub.

SUMMARY

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

To address the above-discussed deficiencies, it is a primary object to provide a washing machine for preventing abnormal vibration that occurs in a rotating tub by limiting a movement path of wash water so as to maintain an equilibrium state without deviating to one side the wash water that is not drained during dry-spin of a laundry formed of a waterproof material.

The present disclosure also provides a washing machine that prevents a laundry being damaged by preventing some laundries from being deviated from a rotating tube during wash of a large laundry or a large amount of laundries.

According to an aspect of the present disclosure, a washing machine includes a water tub configured to store wash water, a rotating tub configured to be rotatably installed in the water tub and to include an opening formed in an upper end portion thereof, and a driver configured to be connected to the rotating tub and to rotate the rotating tub, wherein a deviation preventer configured to prevent wash water in the rotating tub from being deviated to one side during rotation of the rotating tub is formed at an upper end portion of the rotating tub.

According to another aspect of the present disclosure, a washing machine includes a water tub configured to store wash water, a rotating tub configured to be rotatably installed in the water tub and to include an opening formed in an upper end portion thereof, and a driver configured to be connected to the rotating tub and to rotate the rotating tub, wherein a separation preventer configured to protrude toward a central axis of the rotating tub from an inner circumference surface of the rotating tub in a circumferential direction of the rotating tub is formed at an upper end portion of the rotating tub.

According to another aspect of the present disclosure, a washing machine includes a water tub configured to store wash water, a rotating tub configured to be rotatably installed in the water tub and to include an opening formed in an upper end portion thereof, and a driver configured to be connected to the rotating tub and to rotate the rotating tub, wherein a deviation preventer configured to prevent wash water in the rotating tub from being deviated to one side during rotation of the rotating tub and a separation preventer configured to protrude toward a central axis of the rotating tub from an inner circumference surface of the rotating tub in a circumferential direction of the rotating tub are formed at an upper end portion of the rotating tub.

Additional and/or other aspects and advantages of the disclosure will be set forth in part in the description which follows and, in part, will be obvious from the description, or may be learned by practice of the disclosure.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device. Certain example embodiments of the present disclosure will now be described in greater detail with reference to the accompanying drawings. In the following description of the present disclosure, a detailed description of known functions and configurations incorporated herein will be omitted when it may make the subject matter of the present disclosure unclear. To help the understanding of the present disclosure, the accompanying drawings are not shown on an actual scale and dimensions of some components are exaggerated.

Figure 1:
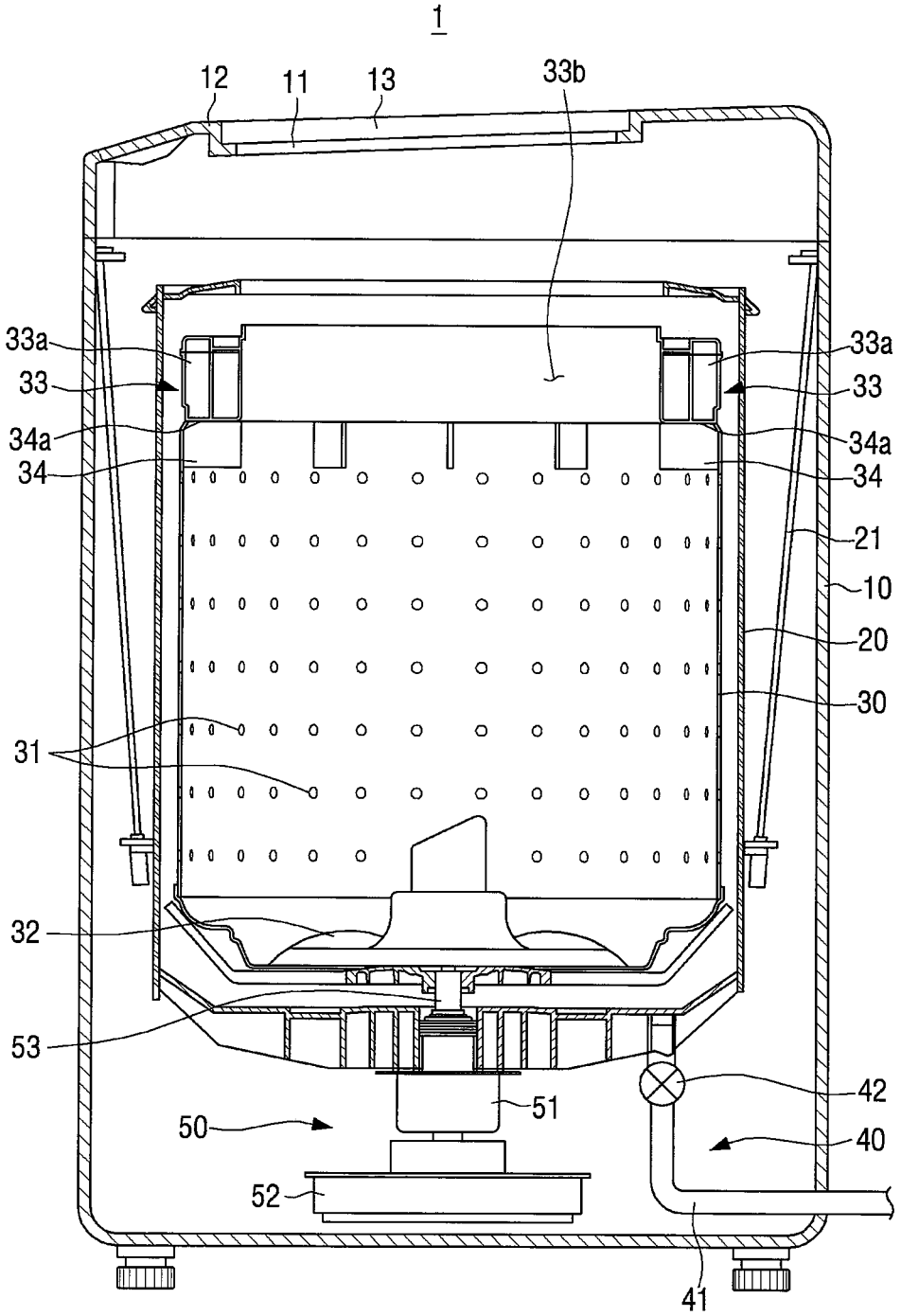
FIG. 1 is a cross-sectional view of a washing machine according to an example embodiment of the present disclosure.

Referring to FIG. 1, a washing machine 1 according to an example embodiment of the present disclosure may include a cabinet 10, a water tub 20, a rotating tub 30, and a driver 50 in order to wash a laundry L.

The cabinet 10 may form an outer appearance and include an upper cover 12 that is formed in an upper portion of the cabinet 10 and includes a feeding inlet 11 of the laundry L so as to feed the laundry L into the rotating tub 30. The upper cover 12 may include a door 13 that opens and closes the feeding inlet 11 of the laundry L.

The water tub 20 may be provided to store wash water W in the cabinet 10 and disposed in the cabinet 10 so as to be supported by the cabinet 10 using a suspension device 21. The suspension device 21 may attenuate vibration generated from the water tub 20 during washing or spin-dry.

The rotating tub 30 may be rotatably disposed in the water tub 20, may include an opening 33*b* that is formed in an upper end portion 33 in order to accommodate the laundry L, and may be shaped like an approximately cylindrical and hollow shape. A plurality of through holes 31 may be formed in a lateral surface of the rotating tub 30 so as to pass the wash water W between inner and outer parts of the rotating tub 30. In addition, a balancer 33*a* may be installed at the upper end portion 33 of the rotating tub 30 in order to offset unbalanced load generated from the rotating tub 30 and to stably rotate the rotating tub 30 during high-speed rotation of the rotating tub 30. However, according to the present embodiment, the case in which the balancer 33*a* is installed at the upper end portion 33 of the rotating tub 30 has been described, but it may be possible to omit the balancer 33*a* from the upper end portion 33 of the rotating tub 30.

In addition, a pulsator 32 may be rotatably installed on a bottom of the rotating tub 30 in a forward direction or a reverse direction and may stir the laundry L put in the rotating tub 30 together with the wash water W.

In addition, a water supply device (not shown) for feeding the wash water W into the rotating tub 30 and a detergent supply device (not shown) into the rotating tub 30 may be installed on the rotating tub 30. The water supply device and the detergent supply device are known and thus a detailed description thereof will be omitted here.

In addition, the rotating tub 30 may include a plurality of ribs 34 that is formed at the upper end portion 33 toward a center of the rotating tub 30 from an inner circumference surface of the rotating tub 30 in a radial direction. The plurality of ribs 34 may extend in a longitudinal direction of the rotating tub 30 by as much as a preset length. In addition, one end 34*a* of each of the plurality of ribs 34 may be formed to contact a bottom surface of the balancer 33*a*.

On the other hand, the plurality of ribs 34 may be integrally formed with the balancer 33*a*. In this case, the plurality of ribs 34 may be disposed to contact the inner circumference surface of the rotating tub 30 so as to be coupled to the rotating tub 30 using a general coupling method such as a coupling method using a bolt and a nut or may be attached to the rotating tub 30 via welding.

That is, the plurality of ribs 34 may be disposed to contact the inner circumference surface of the rotating tub 30 in order to prevent the wash water W moved toward an upper portion of the rotating tub 30 from being deviated to one side and to block a movement path of the wash water W and may also be disposed to contact the bottom surface of the balancer 33*a* in order to prevent the wash water W from being moved to the upper portion of the rotating tub 30 and being separated from the rotating tub 30 through the opening 33*b* of the rotating tub 30. In this case, the balancer 33*a* may function as a blocker for blocking upward flow of the wash water W.

On the other hand, when the balancer 33*a* is not installed at the upper end portion 33 of the rotating tub 30, the rotating tub 30 may include a blocker that is formed by bending a portion of an upper end of the rotating tub 30 toward a central axis of the rotating tub 30 in order to prevent the wash water W from being moved upward and being separated from the rotating tub 30 through an opening of the rotating tub 30. In addition, the rotating tub 30 may prevent upward flow of the wash water W by disposing a blocker such as a cover that blocks a portion of an edge of the opening 33*b* on the upper end portion 33 of the rotating tub 30 instead of by bending the portion of the upper end of the rotating tub 30 toward the central axis of the rotating tub 30.

Due to this configuration, the wash water W in the rotating tub 30 is limited from flowing in circumferential and upward directions of the rotating tub 30 so as to be prevented from being deviated to one side in the rotating tub 30.

With reference to FIGS. 2 to 6, the plurality of ribs 34 will be described in relation to flow of the wash water W in the rotating tub 30 according to rotation of the rotating tub 30 when the laundry L formed of a waterproof material is washed.

Figure 2:
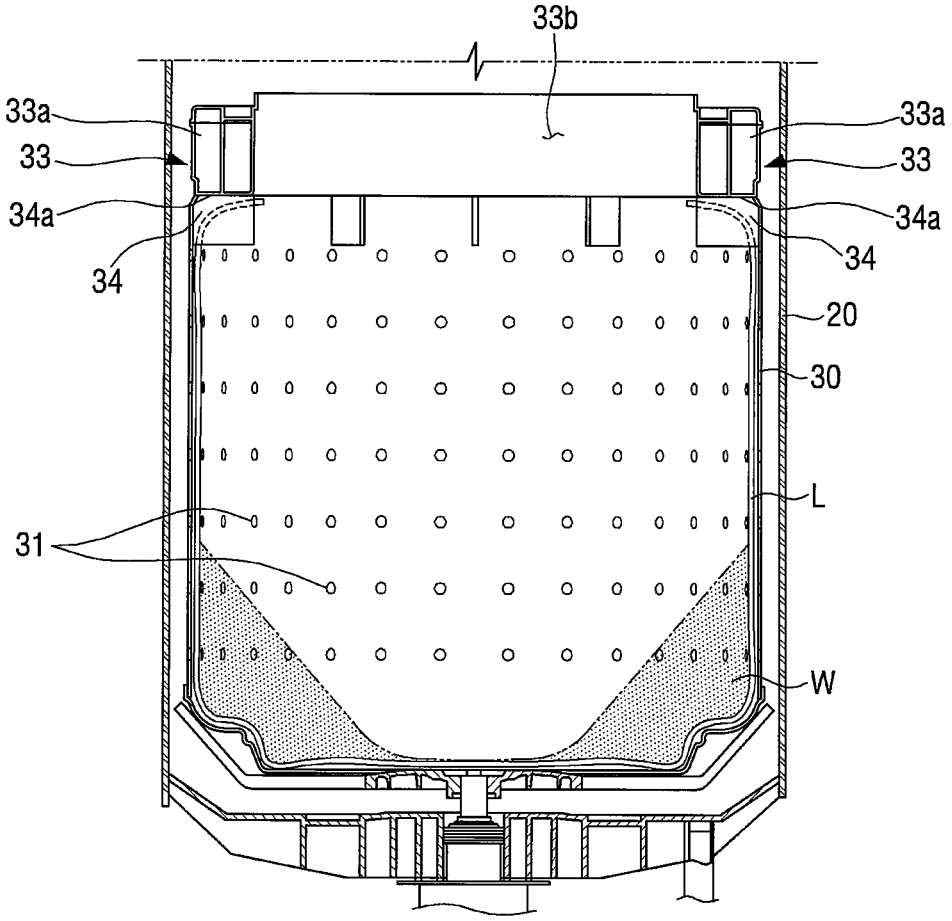
FIG. 2 is a cross-sectional view of an internal portion of a rotating tub when the washing machine illustrated in FIG. 1 is rotated at low speed.

Referring to FIG. 2, when the washing machine 1 washes or dry-spins the laundry L, the rotating tub 30 may be rotated by the driver 50. In this case, the laundry L is inclined to a lateral surface of the rotating tub 30 by a centrifugal force and accordingly blocks the through holes 31 of the rotating tub 30. Since the laundry L is formed of a waterproof material, the wash water W in the rotating tub 30 may not be discharged outside the rotating tub 30 through the through holes 31 and may be moved toward the lateral surface of the rotating tub 30 by a centrifugal force.

Figure 3:
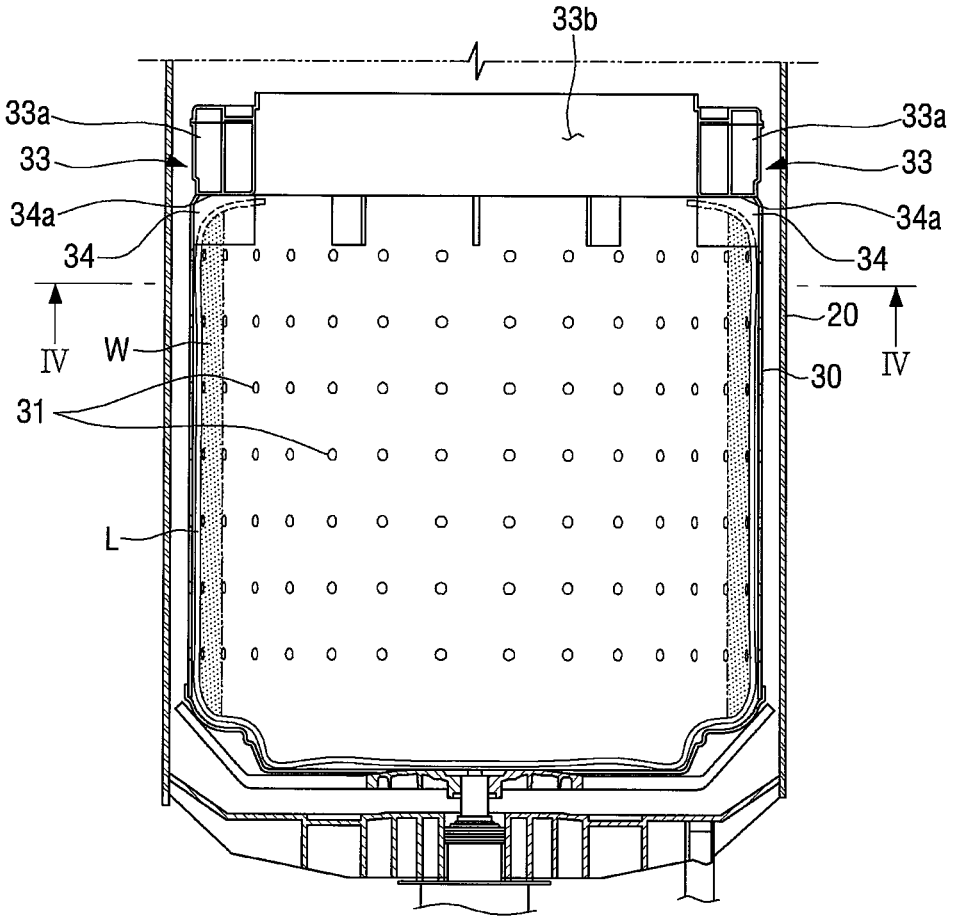
FIG. 3 is a cross-sectional view of an internal portion of a rotating tub when the washing machine illustrated in FIG. 1 is rotated at higher speed than the washing machine illustrated in FIG. 2.
Figure 4:
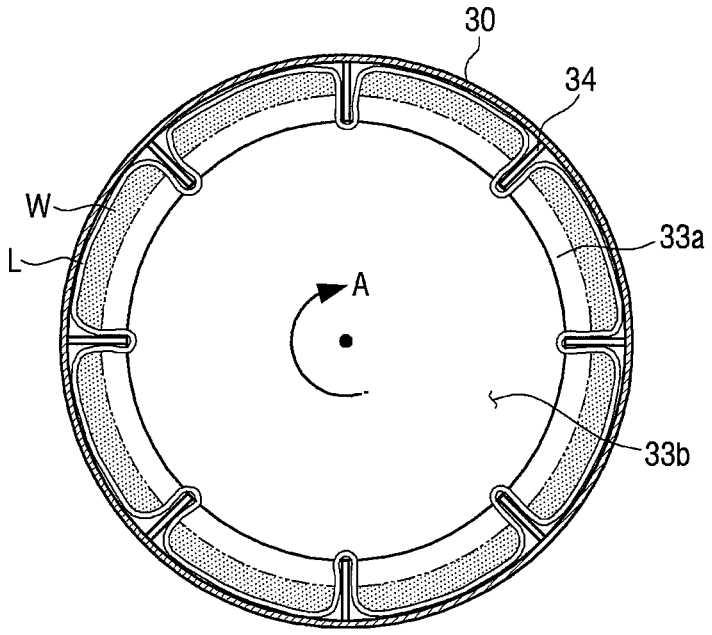
FIG. 4 is a cross-sectional view taken along a line IV-IV of FIG. 3.

Then, referring to FIGS. 3 and 4, the rotating tub 30 may be more rapidly rotated and accordingly, the entire wash water W may be moved toward the lateral surface of the rotating tub 30. In this case, the wash water W that is moved up to the upper end portion 33 of the rotating tub 30 may be uniformly distributed in spaces between the ribs 34, as illustrated in FIG. 4. That is, the wash water W may be maintained in an equilibrium state and the rotating tub 30 may be normally rotated without abnormal vibration.

Figure 5:
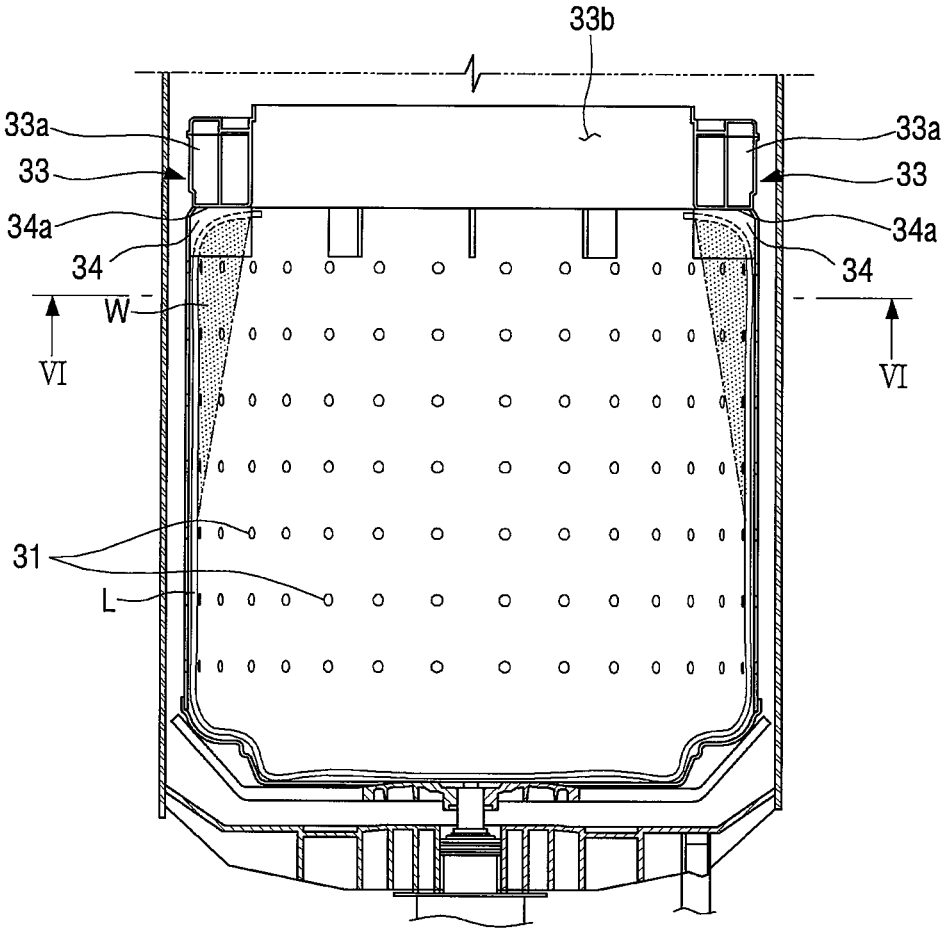
FIG. 5 is a cross-sectional view of an internal portion of a rotating tub when the washing machine illustrated in FIG. 1 is rotated at higher speed than the washing machine illustrated in FIG. 3.
Figure 6:
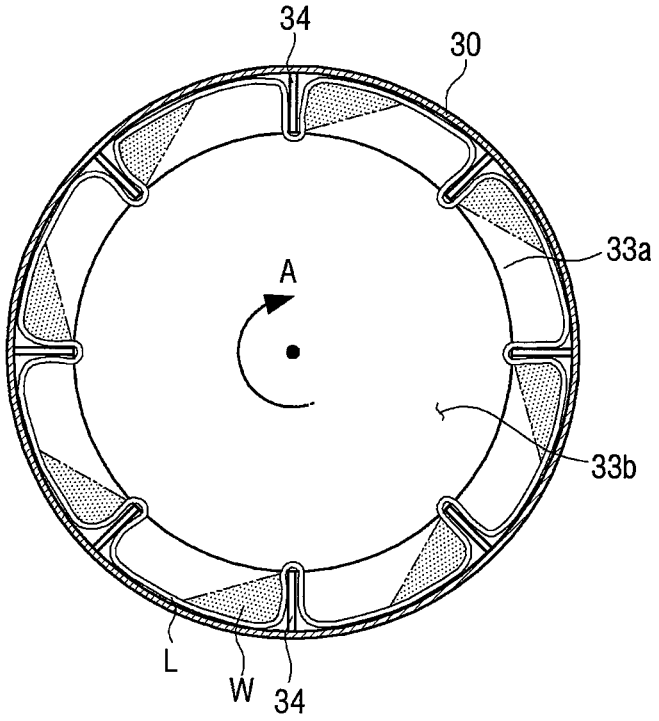
FIG. 6 is a cross-sectional view taken along a line VI-VI of FIG. 5.

Then, referring to FIGS. 5 and 6, the rotating tub 30 may be more rapidly rotated than in FIG. 3 and accordingly, the wash water W may be moved toward an upper portion of the lateral surface of the rotating tub 30. In this case, as illustrated in FIG. 4, the wash water W may be uniformly distributed at the lateral surface of the rotating tub 30 and may be maintained in an equilibrium state but may be deviated to one side of the rotating tub 30 so as to be in a disequilibrium state. Accordingly, the plurality of ribs 34 according to the example embodiment of the present disclosure may prevent the wash water W from being deviated to one side.

In detail, referring to FIG. 6, when the wash water W in the rotating tub 30 is being just moved toward one side, each rib 34 may block the movement path of the wash water W so as to prevent the wash water W from being moved toward one side. That is, in FIG. 6, when the rotating tub 30 is rotated in a direction A, the wash water W may be prevented from being blocked by each rib 34 and being deviated to one side.

With regard to the ribs 34, a height of each rib 34 protruding from the inner circumference surface of the rotating tub 30 and a length of each rib 34 extending in a longitudinal direction of the rotating tub 30 may be determined in consideration of the amount of the wash water W accommodated in the rotating tub 30.

In addition, in the present embodiment, the case in which 8 ribs 34 are used has been described, but 7 or less or 9 or more ribs 34 may be used in consideration of the amount of the wash water W accommodated in the rotating tub 30. However, the number of ribs 34 may be determined in consideration of manufacturing costs and manufacturing processes. In addition, intervals between the ribs 34 may be the same in order to maintain equilibrium. In addition, the plurality of ribs 34 may be formed of a metallic or plastic material.

As described above, the ribs 34 may be formed in such a way that the one end 34*a* contacts the bottom surface of the balancer 33*a* so as to completely block a path in which the wash water W is moved. That is, the plurality of ribs 34 may be arranged to contact both the inner circumference surface of the rotating tub 30 and the bottom surface of the balancer 33*a*. Accordingly, the plurality of ribs 34 may prevent the wash water W that is not discharged from being deviated to one side, thereby preventing abnormal vibration of the rotating tub 30.

Likewise, the washing machine 1 according to the example embodiment of the present disclosure may prevent the wash water W from being deviated to one side by the plurality of ribs 34 so as to prevent abnormal vibration from occurring in the rotating tub 30, thereby preventing the washing machine 1 from being damaged.

A drain device 40, for discharging the wash water W outside the cabinet 10 after wash or dry-spin process is completed, and the driver 50 for rotating the rotating tub 30 may be disposed below the rotating tub 30.

The drain device 40 may include a drain pipe 41, which is connected to a lower portion of the water tub 20 so as to guide water of the water tub 20 to be externally discharged, and a drain valve 42 that is disposed in the drain pipe 41 so as to open and close the drain pipe 41.

The driver 50 may be disposed below the water tub 20 and may receive power to generate a rotation force so as to rotate the rotating tub 30 connected to the driver 50. The driver may include a clutch 51, a driving motor 52, and a rotation axis 53.

The clutch 51 may selectively rotate the rotating tub 30 and the pulsator 32. In detail, the clutch 51 may receive a rotation force from the driving motor 52 and may selectively rotate the pulsator 32 and the rotating tub 30 connected to the rotation axis 53. That is, when the clutch 51 is coupled to the rotating tub 30, the rotating tub 30 may be rotated, and when the clutch 51 is coupled to the pulsator 32, the pulsator 32 may be rotated.

Accordingly, the driver 50 of the washing machine 1 according to the example embodiment of the present disclosure may provide a rotation force in a forward or reverse direction only to the pulsator 32 so as to rotate the pulsator 32 in the forward or reverse direction during washing and rinse and may provide a rotation force in any one of the directions both to the rotating tub 30 and the pulsator 32 so as to simultaneously rotate the rotating tub 30 and the pulsator 32 in any one of the directions during dry-spin. On the other hand, the rotating tub 30 may also be configured to rotate the rotating tub 30 together with the pulsator 32 during washing and rinse.

The driving motor 52 may generate a rotation force so as to drive the clutch 51, thereby rotating the rotating tub 30 and/or the pulsator 32.

The rotation axis 53 may be connected to a lower portion of the rotating tub 30 and the pulsator 32 disposed on a bottom surface of an inner portion of the rotating tub 30 so as to rotate the rotating tub 30 and/or the pulsator 32, and the rotating tub 30 and the pulsator 32 may be selectively rotated by the clutch 51 of the driver 50.

Hereinafter, an operation of the washing machine 1 configured as described above according to the example embodiment of the present disclosure will be described. In this case, since washing and rinse operations may be the same as in a general washing machine 1, a detailed description thereof will be omitted and a dry-spin operation will be described in detail.

The washing machine 1 that begins to be operated by a user may begin to perform dry-spin after washing and rinse operations are performed. In this case, the washing machine 1 may rotate the rotating tub 30 and the pulsator 32 through the driver 50.

During this operation, in the case of the laundry L formed of a general material, the wash water W that is moved toward a lateral surface due to a centrifugal force during dry-spin may be discharged outside the rotating tub 30 through the through holes 31 of the rotating tub 30. However, when a laundry formed of a waterproof material is included in the laundry L, the laundry L may block the through holes 31 of the rotating tub 30, and thus the wash water W may not be discharged outside the rotating tub 30 through the through holes 31 due to the laundry L formed of a waterproof material and may be rotated together with the laundry L in the rotating tub 30. That is, as illustrated in FIG. 2, the wash water W may be moved toward the lateral surface of the rotating tub 30 by a centrifugal force.

Then, the rotating tub 30 may be more rapidly rotated, and the entire wash water W in the rotating tub 30 may be moved toward the lateral surface of the rotating tub 30, as illustrated in FIG. 3. In this case, as illustrated in FIG. 4, the wash water W that is moved to an upper portion at which the plurality of ribs 34 is formed may be uniformly distributed in the spaces between the ribs 34 so as to be in an equilibrium state.

Then, the rotating tub 30 may be more rapidly rotated than in FIG. 3 and accordingly, the wash water W may be moved toward the upper end portion 33 of the rotating tub as illustrated in FIG. 5. In this case, when the wash water W is just deviated to one end by rotation of the rotating tub 30, movement of the wash water W may be limited by the plurality of ribs 34, as illustrated in FIG. 6. Accordingly, the wash water W may be still maintained in an equilibrium state, and abnormal vibration may not occur in the rotating tub 30.

Figure 7:
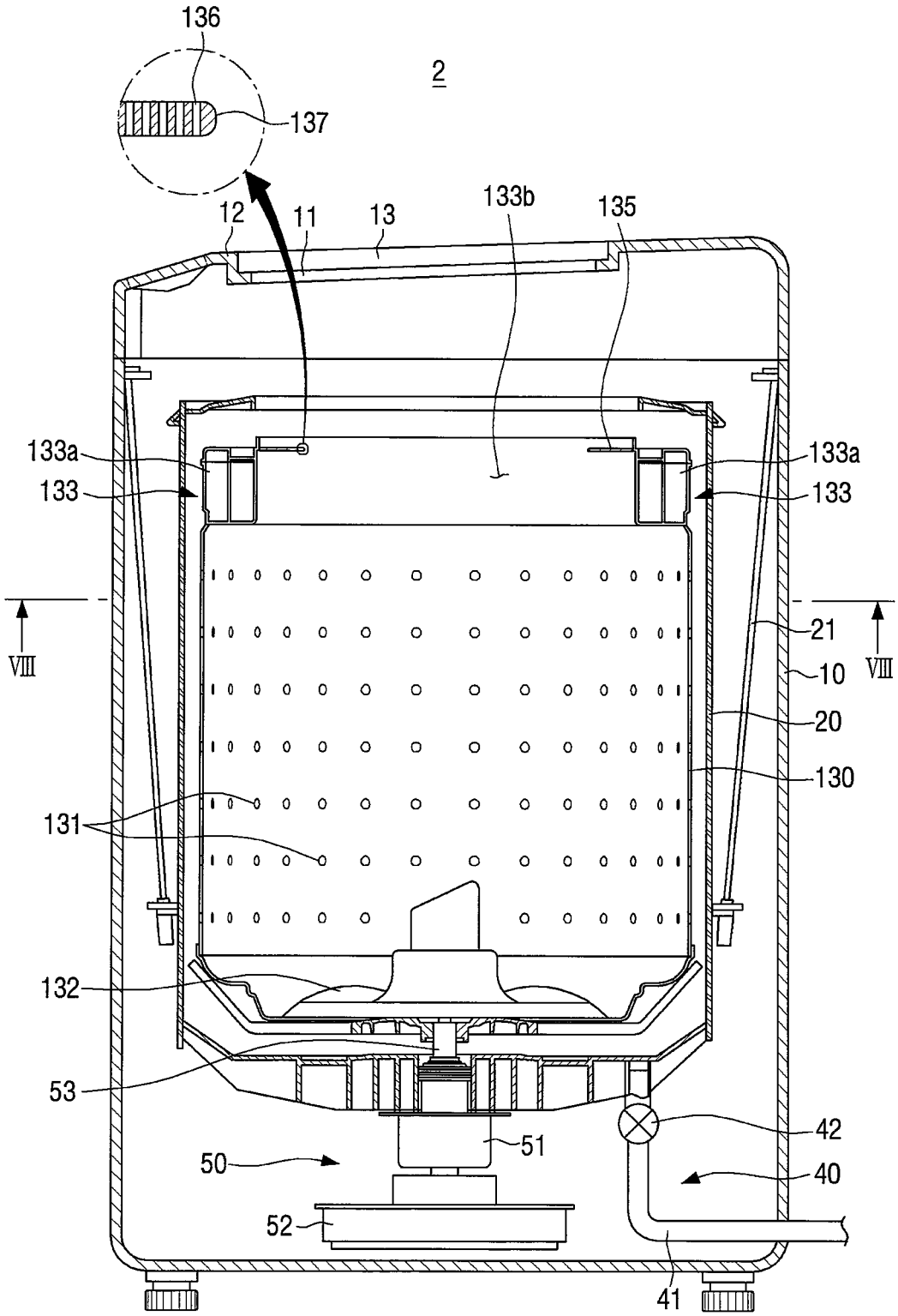
FIG. 7 is a cross-sectional view of a washing machine according to another example embodiment of the present disclosure.
Figure 8:
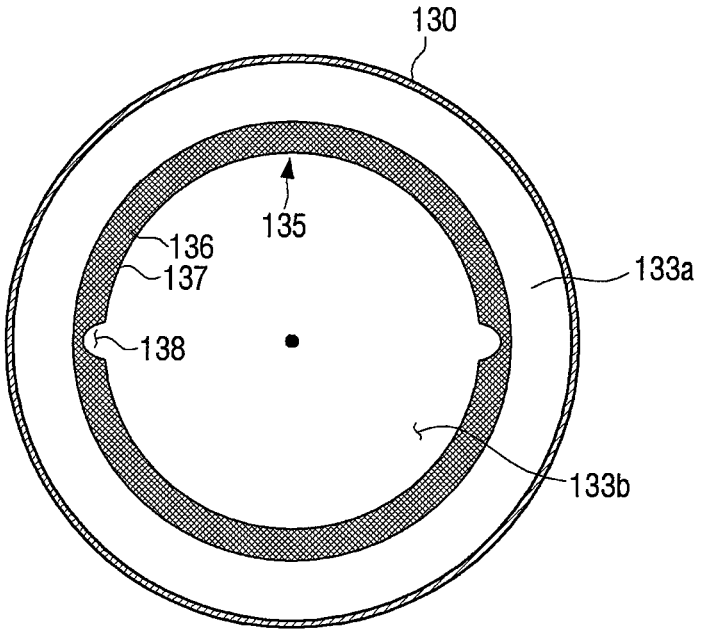
FIG. 8 is a cross-sectional view taken along a line VIII-VIII of FIG. 7.

With reference to FIGS. 7 and 8, a washing machine 2 according to another example embodiment of the present disclosure will be described. However, with regard to a description of components of the washing machine 2 according to another example embodiment of the present disclosure, the same components as in the example embodiment of the present disclosure are denoted by the same reference numeral, a detailed description thereof will be omitted, and only a difference from the example embodiment of the present disclosure will be described.

The washing machine 2 according to another example embodiment of the present disclosure may include the cabinet 10, the water tub 20, a rotating tub 130, and the driver 50. The cabinet 10, the water tub 20, and the driver 50 are the same as in the example embodiment of the present disclosure, and thus a detailed description thereof will be omitted and a difference from the example embodiment of the present disclosure will be described in detail.

The rotating tub 130 of the washing machine 2 according to another example embodiment of the present disclosure may be rotatably disposed in the water tub 20 and may include an opening 133*b* that is formed in an upper end portion 133 and is shaped like an approximately cylindrical and hollow shape in order to accommodate the laundry L. A plurality of through holes 131 may be formed in the lateral surface of the rotating tub 130 so as to pass the wash water W inside and outside the rotating tub 130. In addition, the upper end portion 133 of the rotating tub 130 may include a balancer 133*a* that offsets unbalanced load generated from the rotating tub 130 and stably rotates the rotating tub 130 during high-speed rotation of the rotating tub 130, and a pulsator 132 may be rotatably installed on a bottom surface of the rotating tub 130 in a forward or reverse direction. However, the aforementioned balancer 133*a* may be omitted.

In addition, the upper end portion 133 may include a separation preventer 135 that is continuously formed on the inner circumference surface toward a central axis of the rotating tub 130 in a circumferential direction of the rotating tub 130. The separation preventer 135 may be formed to block a portion of an edge of the opening 133*b* of the rotating tub 130.

In detail, with reference to FIGS. 7 and 8, the separation preventer 135 may be formed at an upper end of the inner circumference surface of the rotating tub 130, may have an external diameter that is approximately the same as an internal diameter of the rotating tub 130, may have an internal diameter that is smaller than the external diameter by a predetermined length, and may be shaped like a circular shape with a space through which the laundry L is passed. However, a position at which the separation preventer 135 is formed may not be limited to the upper end of the rotating tub 130 and accordingly may be formed at an arbitrary position of the upper end portion 133 of the rotating tub 130. However, the separation preventer 135 may be formed at the upper end of the rotating tub 130 in order to ensure a maximum washing capacity. The separation preventer 135 may be integrally injection-molded with the balancer 133*a*, and when the balancer 133*a* is not used, the separation preventer 135 may be integrally injection-molded with the rotating tub 130.

In addition, the separation preventer 135 may include a plurality of through holes 136 in order to easily discharge the wash water W. The wash water W that is separated from the laundry L during dry-spin of the laundry L may be easily discharged outside the rotating tub 130 through the separation preventer 135 by the plurality of through holes 136. In addition, when the wash water W and detergent are supplied from an upper side by the water supply device and the detergent supply device, the plurality of through holes 136 may allow the wash water W and the detergent to be uniformly mixed. According to the present embodiment, although the separation preventer 135 is illustrated to be shaped like a mesh, it may be possible to form the plurality of through holes 136 simply by forming holes through a circular plate.

In addition, an internal end portion 137 of the separation preventer 135 may be formed with a curved surface having a predetermined curvature so as to prevent hands from being hurt when a user takes the laundry L in the rotating tub 130 out of the rotating tub 130. The internal end portion 137 may also prevent the laundry L from being damaged when the laundry L is taken out of or put into the rotating tub 130. In addition, the separation preventer 135 may be formed of a plastic, rubber, or the like which has predetermined elasticity. Accordingly, when the user put the laundry L into the rotating tub 130 or takes the laundry L out of the rotating tub 130, a space through which the laundry L is passed may be ensured.

In addition, the separation preventer 135 may include escaping grooves 138 formed at opposite positions so as to pass the pulsator 132 through the opening 133*b* of the rotating tub 130 along an internal space of the separation preventer 135.

In detail, in order to maintain and repair the pulsator 132, a user or an operator needs to separate the pulsator 132 from the rotating tub 130 and to take the pulsator 132 out of the rotating tub 130. In this case, a diameter of the pulsator 132 is greater than an internal diameter of the separation preventer 135, and thus the separation preventer 135 may include the escaping grooves 138 so as to pass the pulsator 132 therethrough. That is, in this case, the external diameter of the pulsator 132 may have a smaller diameter than a diameter of a portion of the separation preventer 135, in which the escaping groove 138 is formed, by a predetermined length, and thus, the pulsator 132 may be easily passed through the separation preventer 135.

Accordingly, the user or the operator may take the pulsator 132 out of the rotating tub 130 and maintain and repair the pulsator 132. According to the present embodiment, the escaping groove 138 is formed with a semicircular shape but is not limited thereto, and the escaping groove 138 may be shaped like a rectangular shape or a triangular shape that is tapered toward the external diameter.

By virtue of the separation preventer 135, when the large laundry L such as blankets, curtains, and bed sheets is washed, the washing machine 2 according to another example embodiment of the present disclosure may prevent the laundry L from being externally separated through the opening 133*b* of the rotating tub 130. In addition, the amount of the laundry L that is simultaneously washed may be increased.

Hereinafter, an operation of the washing machine 2 configured as described above according to another example embodiment of the present disclosure will be described.

The washing machine 2 that begins to be operated by a user may rotate the rotating tub 130 and/or the pulsator 132 through the driver 50 for washing, rinse, and spin-dry.

In this case, when the large laundry L is washed or a large amount of laundry L is washed, the separation preventer 135 may prevent the laundry L from being separated out of the rotating tub 130, thereby preventing the laundry L from being separated from the rotating tub 130 and preventing the laundry L from being damaged by the water tub 20 or the cabinet 10. However, the plurality of through holes 136 are formed in the separation preventer 135, and thus the wash water W may be discharged out of the rotating tub 130 so as to facilitate dry-spin.

In addition, the internal end portion 137 of the separation preventer 135 may be formed with a curved surface so as to prevent hands from being hurt when a user puts the laundry L into the rotating tub 130 or takes the laundry L in the rotating tub 130 out of the rotating tub 130 and to prevent the laundry L from being damaged by the internal end portion 137 of the separation preventer 135.

In addition, when components disposed in the pulsator 132 or the rotating tub 130 need to be maintained and repaired, the pulsator 132 or other components may be easily taken out of the rotating tub 130 through the escaping grooves 138 of the separation preventer 135 so as to be maintained and repaired.

Figure 9:
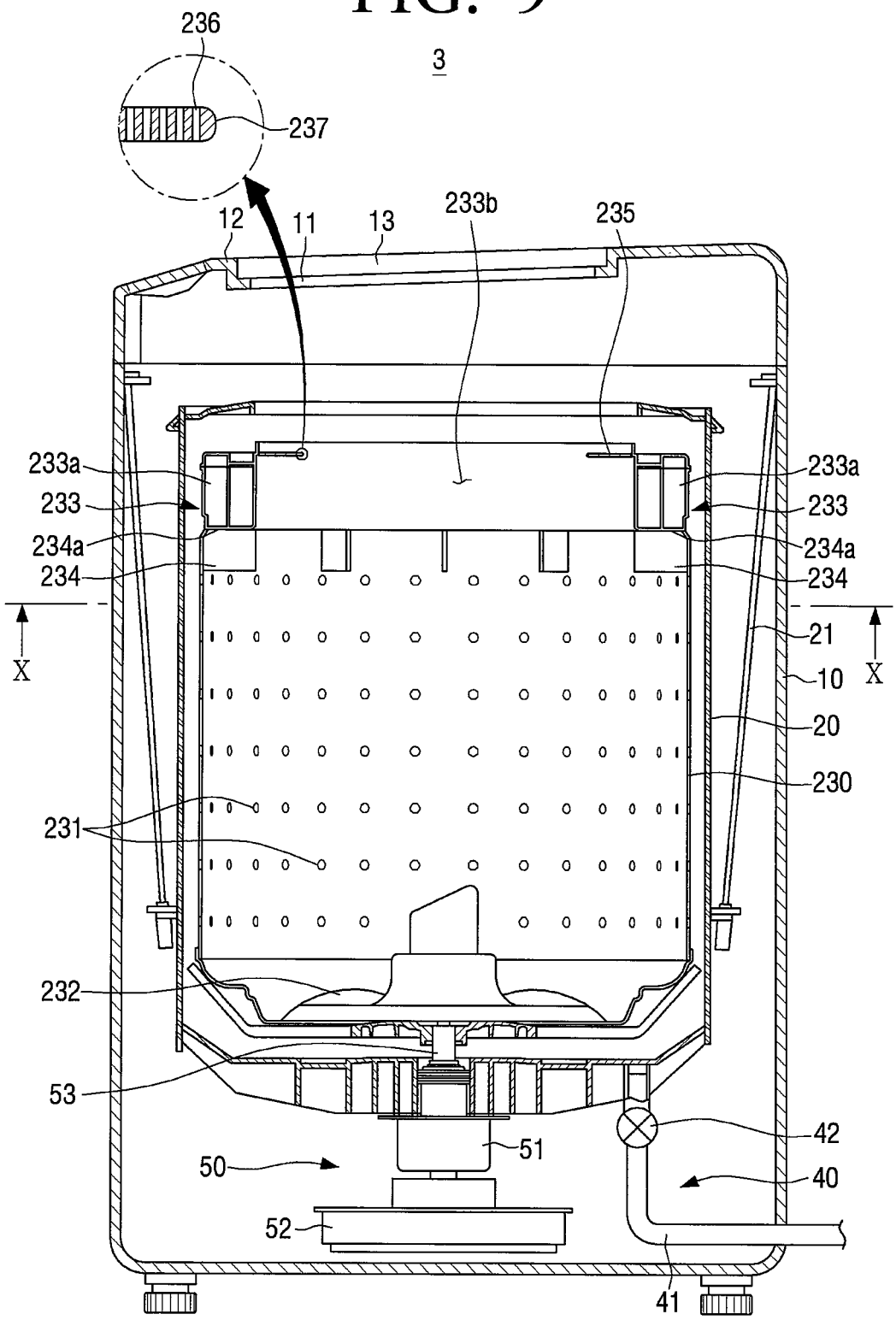
FIG. 9 is a cross-sectional view of a washing machine according to a yet another example embodiment of the present disclosure.
Figure 10:
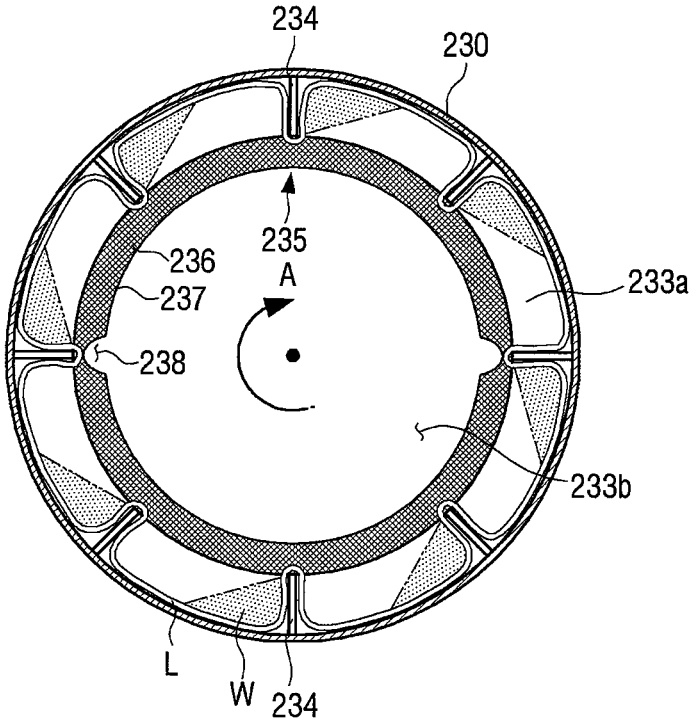
FIG. 10 is a cross-sectional view taken along a line X-X of FIG. 9.

With reference to FIGS. 9 and 10, a washing machine 3 according to yet another example embodiment of the present disclosure will be described. However, with regard to a description of components of the washing machine 3 according to the yet another example embodiment of the present disclosure, the same components as in the example embodiment of the present disclosure are denoted by the same reference numeral, a detailed description thereof will be omitted, and only a difference from the example embodiment of the present disclosure will be described.

The washing machine 3 according to the yet another example embodiment of the present disclosure may include the cabinet 10, the water tub 20, a rotating tub 230, and the driver 50. The cabinet 10, the water tub 20, and a driver 50 are the same as in the example embodiment of the present disclosure, and thus a detailed description thereof will be omitted and the rotating tub 230 as a difference from the example embodiment of the present disclosure will be described in detail.

Referring to FIGS. 9 and 10, the rotating tub 230 of the washing machine 3 according to the yet another example embodiment of the present disclosure may be rotatably disposed in the water tub 20, may include an opening 233*b* that is formed in an upper end portion 233 in order to accommodate the laundry L, and may be shaped like an approximately cylindrical and hollow shape. A plurality of through holes 231 may be formed in a lateral surface of the rotating tub 230 so as to pass the wash water W between inner and outer parts of the rotating tub 230. In addition, the upper end portion 233 of the rotating tub 230 may include a balancer 233*a* that offsets unbalanced load generated from the rotating tub 230 and to stably rotate the rotating tub 230 during high-speed rotation of the rotating tub 230, and a pulsator 232 may be rotatably installed on a bottom of the rotating tub 230 in a forward direction or a reverse direction. However, the balancer 233*a* may be omitted.

In addition, the upper end portion 233 may include a plurality of ribs 234 that is formed toward a central axis of the rotating tub 230 from an inner circumference surface of the rotating tub 230 in a radial direction. The plurality of ribs 234 may extend in a longitudinal direction of the rotating tub 230 by as much as a preset length and one end 234*a* may be formed to contact a bottom surface of the balancer 233*a*. On the other hand, the plurality of ribs 234 may extend from the balancer 233*a* in a longitudinal direction of the rotating tub 230, and when the balancer 233*a* is not used, the plurality of ribs 234 may extend from a blocker disposed at an upper end portion 230 of the rotating tub 230. The plurality of ribs 234 are the same as the plurality of ribs 34 according to the example embodiment of the present disclosure, and thus a detailed description thereof will be omitted here.

In addition, the upper end portion 233 may include a separation preventer 235 that is formed on the inner circumference surface toward a central axis of the rotating tub 230 in a circumferential direction of the rotating tub 230. The separation preventer 235 is the same as the separation preventer 135 according to another example embodiment of the present disclosure and thus a detailed description thereof will be omitted here.

Likewise, the washing machine 3 according to the yet another example embodiment of the present disclosure may include both of the plurality of ribs 234 for preventing the wash water W from being deviated to one side and the separation preventer 235 for preventing the laundry L from being separated from the rotating tub 230. Accordingly, as illustrated in FIG. 10, by virtue of the plurality of ribs 234, the washing machine 3 according to the yet another example embodiment of the present disclosure may prevent the wash water W from being deviated to one side so as to prevent abnormal vibration from occurring in the rotating tub 230 when the rotating tub 230 is rotated in a direction A, and when the large laundry L is washed or a large amount of laundry L is washed, the separation preventer 235 may prevent the laundry L from being separated out of the rotating tub 230 through the opening 233*b*, thereby preventing the rotating tub 230 from being damaged.

In addition, an internal end portion 237 of the separation preventer 235 may be formed with a curved surface so as to prevent a user from being hurt by the internal end portion 237 and to prevent the laundry L from being damaged by the internal end portion 237. In addition, by virtue of escaping grooves 238 of the separation preventer 235, components in the rotating tub 230, such as the pulsator 232 may be easily maintained and repaired.

Although the present disclosure has been described with an example embodiment, various changes and modifications may be suggested to one skilled in the art. It is intended that the present disclosure encompass such changes and modifications as fall within the scope of the appended claims.

What is claimed is:

1. A washing machine comprising:

a water tub configured to store wash water;

a rotating tub configured to be rotatably installed in the water tub and comprising an opening formed in an upper end portion thereof;

a balancer installed at a upper end portion of the rotating tub;

a deviation preventer configured to prevent abnormal vibration from occurring in the rotating tub; and a separation preventer configured to protrude toward a central axis of the rotating tub from an inner circumference surface of the rotating tub in a circumferential direction of the rotating tub.

2. The washing machine of claim 1, wherein the deviation preventer and the separation preventer are formed at the balancer.

3. The washing machine of claim 1, wherein the deviation preventer comprises a plurality of ribs integrally formed with a bottom of the balancer and extending downward from the bottom of the balancer to at least partially block movement of wash water.

4. The washing machine of claim 3, wherein the plurality of ribs is extended in a radial direction of the central axis of the rotating tub.

5. The washing machine of claim 3, wherein the plurality of ribs is arranged with a same interval.

6. The washing machine of claim 3, wherein the plurality of ribs is formed in a longitudinal direction of the rotating tub.

7. The washing machine of claim 3, wherein the bottom of the balancer is substantially parallel to a bottom of the rotating tub.

8. The washing machine of claim 1, wherein the separation preventer is continuously formed along an inner circumference surface of the balancer.

9. The washing machine of claim 1, wherein an internal end portion of the separation preventer is formed with a curved surface having a preset curvature.

10. The washing machine of claim 1, wherein the separation preventer is formed integrally with the balancer.

11. The washing machine of claim 1, wherein the separation preventer comprises a plurality of through holes.

12. The washing machine of claim 11, wherein the plurality of through holes of the separation preventer is configured to discharge wash water.

13. The washing machine of claim 11, wherein the plurality of through holes of the separation preventer is configured to uniformly mix wash water and detergent.

14. The washing machine of claim 11, wherein the plurality of through holes of the separation preventer is mesh shaped.

15. The washing machine of claim 1, wherein the separation preventer comprises escaping grooves formed at opposite positions so as to pass a pulsator, configured to be detachably connected to a driver in the rotating tub, through the balancer.

16. The washing machine of claim 15, wherein an external diameter of the pulsator is smaller than a diameter of a portion of the separation preventer in which the escaping grooves are formed.

17. The washing machine of claim 15, wherein the escaping grooves are formed in a semicircular shape.

18. The washing machine of claim 1, wherein the separation preventer is formed of an elastic material.

* * * * *